US005116276A

United States Patent [19]

Takegawa et al.

[11] Patent Number: 5,116,276

[45] Date of Patent: May 26, 1992

[54] LOCATION OF A SLIT BETWEEN DENTS CORRESPONDING TO A BROKEN WARP

[75] Inventors: Yujiro Takegawa, Kahoku; Souichi Nakai, Kanazawa, both of Japan

[73] Assignee: Tsudakoma Corp., Ishikawa, Japan

[21] Appl. No.: 675,255

[22] Filed: Mar. 27, 1991

[30] Foreign Application Priority Data

Mar. 28, 1990 [JP] Japan ..... 080227
Jun. 8, 1990 [JP] Japan ..... 148694
Jun. 8, 1990 [JP] Japan ..... 2-148695

[51] Int. Cl.[5] ..... D03J 1/14; D03D 23/00

[52] U.S. Cl. ..... 139/351; 139/1 R; 139/35

[58] Field of Search ..... 139/35, 351, 353, 358, 139/192, 1 R, 291 C; 28/209, 211

[56] References Cited

U.S. PATENT DOCUMENTS 4,791,967 12/1988 Vandeweghe et al. ..... 139/353
4,815,498 3/1989 Gryson et al. ..... 139/351
4,817,675 4/1989 Dewaele et al. ..... 139/35
4,872,488 10/1989 Gryson et al. ..... 139/353
4,905,737 3/1990 Gryson ..... 139/353
5,050,643 9/1991 Takegawa et al. ..... 139/35 X

FOREIGN PATENT DOCUMENTS 62-69851 3/1987 Japan .
63-28951 2/1988 Japan .
1-192853 8/1989 Japan .
2-210045 8/1990 Japan .

*Primary Examiner*—Andrew M. Falik
*Attorney, Agent, or Firm*—Wenderoth, Lind & Ponack

[57] ABSTRACT

A method of locating a slit between the dents of the reed of a loom corresponding to a broken warp and to an apparatus for positioning a threading device at a position corresponding to the slit between the dents corresponding to the broken warp. The broken warp or a normal warp in a specific vertically displaced relation with the broken warp is detected by a yarn sensor. The position of a slit between the dents corresponding to the broken warp or that of the normal warp is determined on the basis of the distance traveled by the yarn sensor from its standby position, and a threading device is position corresponding to the slit between the dents corresponding to the broken warp on the basis of the distance traveled by the yarn sensor.

3 Claims, 16 Drawing Sheets

LOCATION OF A SLIT BETWEEN DENTS CORRESPONDING TO A BROKEN WARP

BACKGROUND OF THE INVENTION

1. Field of the Invention

The present invention relates to a method of locating a slit between the dents of the reed of a loom corresponding to a warp when the warp is broken during weaving and to an apparatus for locating a slit between the dents corresponding to the broken warp and for mending the broken warp to restore the normal arrangement of the warps so that the loom can be restarted.

2. Description of the Prior Art

When a warp is broken, a slit between the dents of the reed corresponding to the broken warp, namely, a slit between the dents through which the broken warp is to be drawn through after being mended, must be located in mending the broken warp. The applicant of the present patent application proposed previously an invention relating to the present invention in Japanese Laid-Open Patent Application No. 2-210045. According to this previously proposed invention, the warp adjacent to the broken warp is separated laterally from the broken warp to expand the slit formed between the dents corresponding to the broken warp and the dents corresponding to the broken warp are located through the detection of the expanded slit.

However, if the warp has a comparatively low strength and the dents have a comparatively high rigidity, the warp may possibly be broken or the slit cannot sufficiently be expanded by separating the warp laterally from the broken warp and, consequently, it is impossible to locate the dents corresponding to the broken warp correctly.

SUMMARY OF THE INVENTION

Accordingly, it is an object of the present invention to locate dents corresponding to a broken warp accurately without expanding the slit between the dents.

To achieve the above object, a method of locating a slit between the dents corresponding to a broken warp in one aspect of the present invention, extracts a normal warp in a predetermined positional relation with a broken warp, for example, the normal warp next to the broken warp to the left, at a position between the heddle and the reed; displaces the extracted normal warp vertically, for example, upward; determines the position of the displaced normal warp with respect to the direction of the weaving width; and locates a slit between the dents corresponding to the broken warp with reference to the position of the displaced normal warp and predetermined conditions.

The predetermined conditions specify the positional relation between a slit between the dents corresponding to the broken warp and a slit between the dents corresponding to the normal warp. The predetermined conditions can be determined on the basis of a predetermined drafting plan and the number of a heddle frame supporting a heddle through which the broken warp is drawn and the number of a heddle frame supporting a heddle through which the normal warp is drawn. When each of the warps is drawn through a respective slit of the reed, the predetermined conditions can directly be determined from the positional relation between the broken warp and the normal warp.

Since this method of locating a slit between the dents corresponding to a broken yarn determines the position of the slit between the dents corresponding to the broken warp from the position of the displaced normal warp, the normal warp is not subjected to an excessive tension and the slits between the dents need not be expanded. Accordingly, the method is able to locate the slit between the dents corresponding to the broken warp accurately even if the warp has a low strength and the dents are relatively inflexible.

Another method of the present invention is to locate a slit between the dents corresponding to a broken warp by using the leading portion of the broken warp without using a normal warp in a specific relation with the broken warp.

The method of locating a slit between the dents corresponding to a broken warp in a second aspect of the present invention extracts the leading portion of a broken warp at a position between the corresponding heddle and the reed, displaces vertically the leading portion extending rearward through the reed to separate the leading portion from normal warps, and detects the displaced leading portion of the broken warp to locate the slit between the dents corresponding to the broken warp.

Since the slit between the dents corresponding to the broken warp is located directly from the position of the leading portion of the broken warp through a simple locating procedure, this method requires a simple device and can readily be applied to a loom.

A further object of the present invention is to smoothly locate a slit between the dents corresponding to a broken warp, to position a threading device on the basis of the position of the slit thus located, and to carry out a threading operation after positioning the threading device.

To achieve the further object, a threading device in a third aspect of the present invention is mounted on a moving device integrally consisting of a yarn sensor moving means for moving a yarn sensor in the direction of width of the loom, and a threading device moving means for moving the threading device.

In locating a slit between the dents corresponding to a broken warp, a normal warp in a specific relation with the broken warp, for example, a normal warp next to the broken warp to the left, is extracted and displaced vertically. Then, the yarn sensor is moved from its standby position on one side of the loom along the reed by the yarn sensor moving means to detect the displaced normal warp. The threading device is moved together with the yarn sensor.

Accordingly, the threading device is positioned near the slit between the dents corresponding to the broken warp when the displaced normal warp is detected by the yarn sensor. A decision circuit decides the positional relation between the slit between the dents corresponding to the broken warp and the slit between the dents corresponding to the displaced normal warp from the number of the heddle frame supporting a heddle corresponding to the broken warp or from the identification code of a dropped drop wire and determines the normal distance between the slit between the dents corresponding to the broke warp and the threading device. Upon the detection of the displaced normal wrap by the yarn sensor, the threading device is moved forward or backward by the normal distance determined by the decision circuit to position the threading device accurately at a position corresponding to the slit between the dents corresponding to the broken warp. Thus, the threading device needs to be moved laterally only by a small distance for positioning.

Since the yarn sensor and the threading device are mounted on the same moving means, the threading device can accurately be positioned, so that faulty threading operation is obviated.

DESCRIPTION OF THE PREFERRED EMBODIMENTS

First Embodiment (FIGS. 1 to 18)

FIGS. 1 to 10 are diagrammatic illustrations showing warps on a loom in sequential stages of a method of locating a slit between the dents corresponding to a broken warp in a first embodiment according to the present invention.

Figure 1:
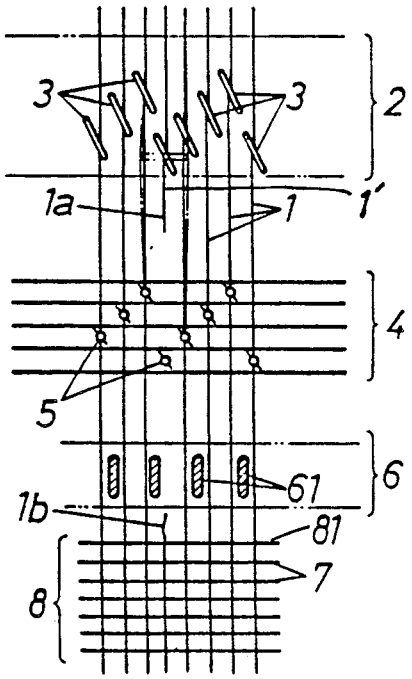
FIGS. 1 to 10 are diagrammatic views for assisting in explaining the steps of a method of locating dents corresponding to a broken warp is first embodiment according to the present invention, FIGS. 1–3, 5, 6, 8 and 9 being plan views, and FIG. 4, 7 and 8 being side views.

Referring to FIG. 1, when a warp 1' among a plurality of warps 1 is broken and a drop wire 3 corresponding to the broken warp 1' drops, a warp stop motion detector 2 detects the breakage of the warp 1' into a trailing portion 1*a* and a leading portion 1*b* (such trailing and leading portions being so labelled in views of the fact that the leading portion 1*b* will be woven into the fabric 8 before the trailing portion) and provides a stop signal to stop the loom automatically at a predetermined angular position. Then, all the heddle frames 4 of the loom are leveled substantially with each other by a leveling device, not shown. The warps 1 are extended in parallel to each other in a sheet and are drawn through frames 5 supported on a plurality of heddles 4, for example, four heddle frames 4, in a predetermined repetitive sequence according to a drawing plan. The warps 1 are drawn through slits between the dents 61 of a reed 6, for example, by drawing two warps through each slit of the reed. The warps 1 are interlaced with a weft 7 at the cloth fell 81 to weave a fabric 8. The two warps 1 drawn between the same dents 61 are in a predetermined relation with respect to the numbers of the heddle frames 4 supporting the heddles 5 through which the two warps 1 are drafted, respectively.

The normal warps 1, i.e., the warps 1 other than the broken warp 1', are separated from the broken warp 1' by a yarn separating device, not shown, such as disclosed in Japanese Patent Laid-open Publication No. 62-69851 (Applicant: TSUDAKOMA Corp.) which reciprocates the dropped drop wire 3 in the direction of the width of the loom or such as disclosed in Japanese Patent Laid-open Publication No. 63-28951 (Applicant: Picanol N.V.) which twist the dropped wire 3.

Figure 2:
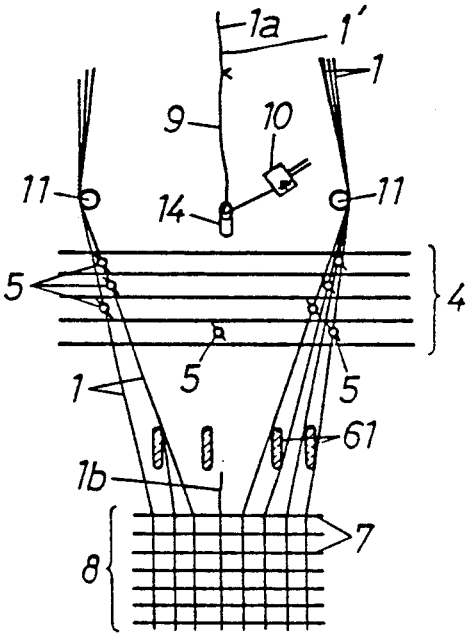

Subsequently, as shown in FIG. 2, a pair of yarn separating members 11 are raised respectively into spaces on the opposite sides of the broken warp 1' in the vicinity of the assembly of the drop wires 3, the yarn separating members 11 are moved laterally respectively in opposite directions, and then the yarn separating members 11 are moved rearwardly to near the rearmost heddle frame 4 to form sufficiently large spaces on the opposite sides of the broken warp 1' in order to facilitate extracting the trailing portion 1*a* of the broken warp 1'. The pair of yarn separating members 11 may be such as employed in a yarn separating device disclosed in Japanese Patent Laid-open Publication No. 1-192853, in which the yarn separating members ar moved along the width of the fabric by a belt or the like, are raised by a vertical pneumatic actuator and are driven for movement in directions for separating the warps 1. Subsequently, a mending yarn 9 is connected to the trailing portion 1*a* of the broken warp 1' by a knotter of a mechanical type or an adhesive bonding type as stated in Japanese Patent Laid-open Publication No. 1-24673, and then the free end of the mending yarn 9 is held by a mending yarn holder 10 and a gripping or suction holder 14 at a position near the slit between the dents 61 corresponding to the leading portion 1*b* of the broken warp 1'.

Figure 3:
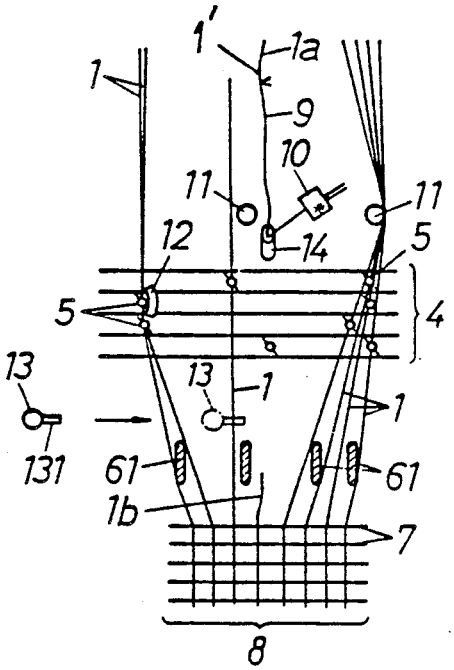

Then, a controller, not shown, detects the number of the heddle frame 4, for example, No. 1, which is supporting the heddle 5 corresponding to the broken warp 1', by a heddle frame number detecting procedure, which will be described after. The controller next determines, on the basis of the detected heddle number and the drawing plan, whether a slit between the dents 61 corresponding to the warp 1 next to the broken warp 1' to the left (i.e. corresponding to the warp 1 to the right of the broken warp 1) is at the pitch of the dents 61 to the left of the slit between the dents 61 corresponding to the broken warp 1' and stores the result of the determination. The decision circuit then determines the number of the heddle frame 4 supporting the heddle 5 corresponding to the warp 1 to the left of the broken warp 1 (e.g. it determines that the warp to the left of the broken warp corresponds to heddle is No. 3), moves a yarn separating member 12 laterally from its standby position according to a signal indicating the position of the dropped drop wire 3 to a position near the broken warp 1', and advances the yarn separating member 12 toward the warp 1 to a position adjacent to, for example, the heddle frame No. 3 as shown in FIG. 3 to restrain heddles 5 supported on the heddle frame No. 3 from movement. Then, the yarn separating member 11 on the left-hand side is moved to the right to allow only the normal warp 1 to the left of the broken warp 1' to move near to the broken warp 1'. Then, a raising member 13 is moved laterally along the reed 6 in a space between the heddle frame 4 and the reed 6 from its standby position to a position directly below the normal warp 1 to the left of the broken warp 1' the raising member 13 is raised to cause a hook 131 thereof to raise the normal warp 1 to a position above the rest of the normal warps 1.

Figure 4:
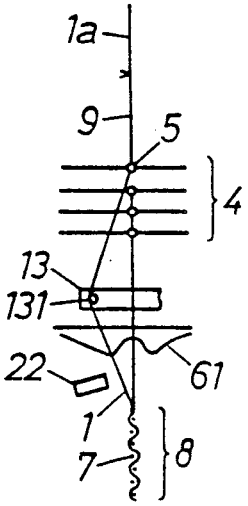

Thus, the next warp 1 on the left of the broken warp 1' is displaced upward along the dents 61 by the raising member 13 as shown in FIG. 4, so that the next warp 1 can be discriminated from the rest of the normal warps 1 by height. Since the thus displaced normal warp 1 is restricted by the dents 61 to move in the direction of the weaving width, the position of at least a portion of the normal warp 1 near the dents 61 with respect to the weaving width coincides accurately with the slits between the dents 61 through which the displaced warp 1 is inserted.

Figure 5:
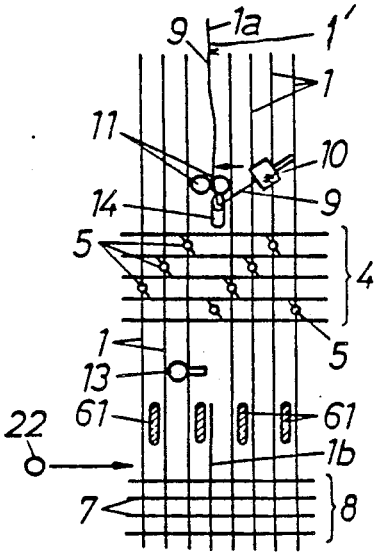

Meanwhile, the pair of yarn separating members 11 are moved toward each other so that all the normal warps 1 are allowed to extend normally in a parallel arrangement as shown in FIG. 5. Then, as shown in FIGS. 4 and 5, a yarn sensor 22 moves laterally along the front side of the reed 6 from its standby position to detect the position of the raising and raised normal warp 1.

Figure 6:
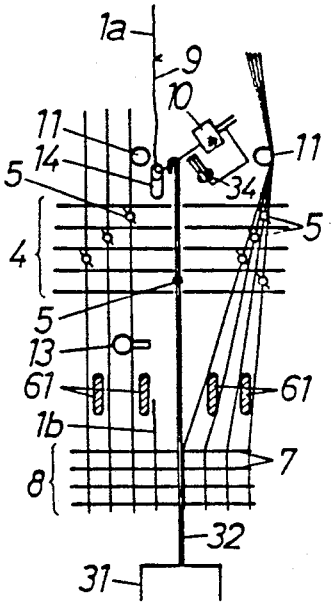
Figure 7:
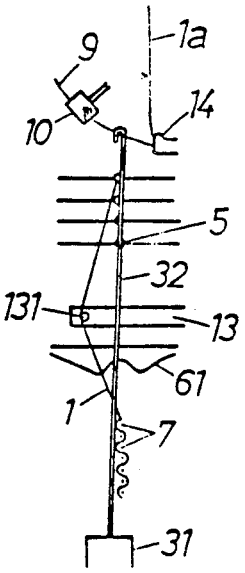

The yarn sensor 22 gives a detection signal representing the position of the raised normal warp 1 to the controller, which stores the detection signal in a storage device. Then, the controller determines on the basis of the detection signal and the previously determined conditions that the slit through which the broken warp 1' is to be drawn through after mending is to the right by the pitch of the dents from the slit corresponding to the detection signal, moves the right-hand yarn separating member 11 to the right as shown in FIG. 6, and then moves a threading device 31 to a position corresponding to the slit through which the broken warp 1' is to be drawn after mending. As shown in FIGS. 6 and 7, the threading device 31 extends a hooked needle 32 through the slit between the dents 61 through which the broken warp 1' is to be drawn after mending and the mail of the corresponding heddle 5, hooks the mending yarn 9 extended between the mending yarn holder 10 and the suction holder 14, and retracts the hooked needle 32 to draw the mending yarn 9 through the mail of the heddle 5 and the slit of the reed 6.

Figure 8:
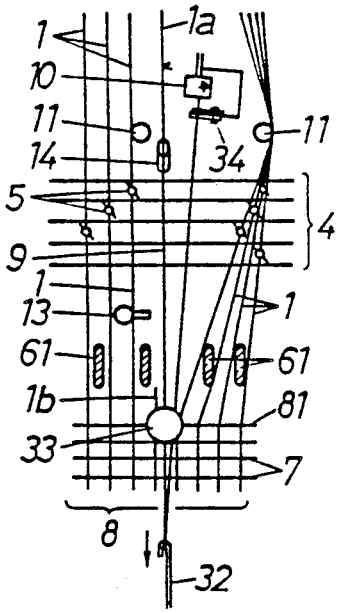

After thus drawing the mending yarn 9, a cutter 34 cuts the mending yarn 9 at a position near the mending yarn holder 10 as shown in FIG. 8, and then the free end of the mending yarn 9 is transferred from the hooked needle 32 to a suction pipe 33 by suction at a position above the cloth fell 81. If necessary, the mending yarn 9 may be tied to the leading portion 1*b* of the broken warp 1'.

Figure 9:
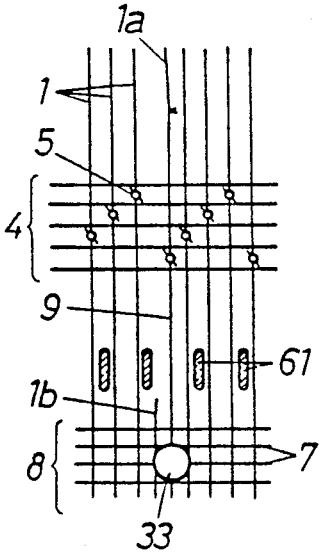
Figure 10:
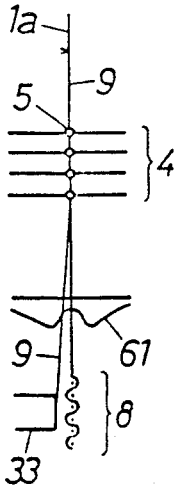

Subsequently, the pair of yarn separating members 11, the yarn separating member 12 and the raising member 13 are lowered and are returned to their standby positions, so that the normal warps 1, the trailing portion 1*a* of the broken warp 1', and the mending yarn 9 connected to the trailing portion 1*a* extend in a parallel arrangement on the same plane as shown in FIGS. 9 and 10. Then, the loom is restarted to weave the mending yarn 9 and the trailing portion 1*a* of the broken warp 1' into the fabric 8. The suction pipe 33 remains stationary or is moved toward the take-up side with the progress of the weaving operation continuing its suction, and is retracted to its standby position after a predetermined time or after a predetermined number of picking cycles. Generally, the portion of the fabric 8 containing the mending yarn 9 is disposed of as a defective section.

Figure 11:
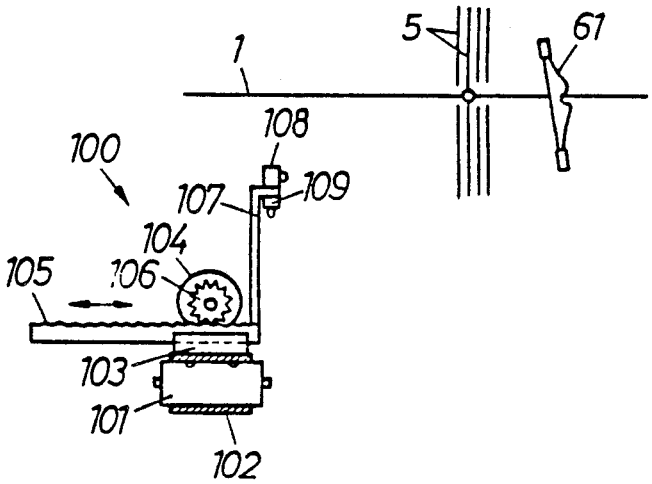
FIGS. 11 to 13 are diagrammatic views for assisting in explaining the steps of a procedure for detecting the number of a heddle.
Figure 12:
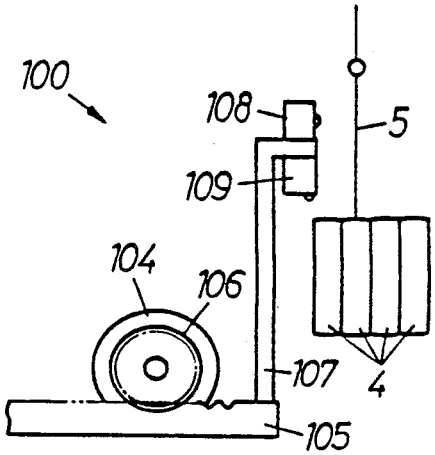
Figure 13:
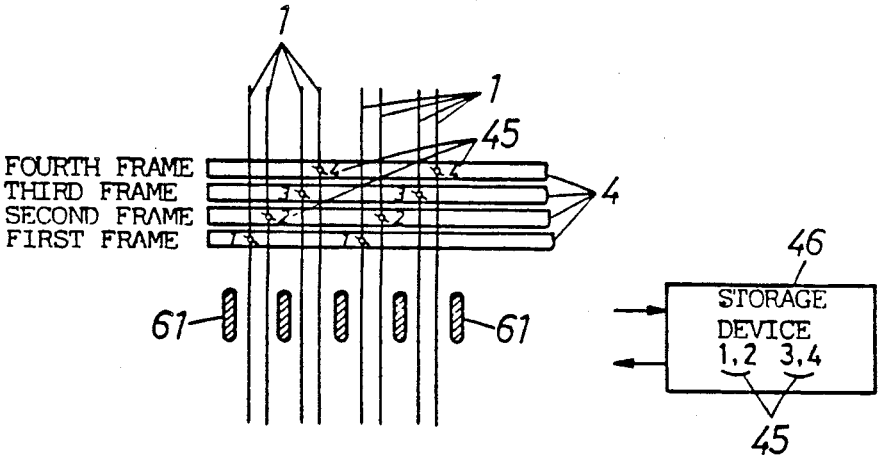

The heddle frame 4 supporting the heddle 5 corresponding to the broken warp 1' is identified by a heddle frame identifying device 100. Referring to FIGS. 11 and 12, the heddle frame identifying device 100 comprises a guide member 103, a rack 105 supported for sliding movement in parallel to the warps 1 on the guide member 103, a pinion 106 engaging the rack 105, a motor 104 for driving the pinion 106, a post 107 extending in a vertical position from the rack 105, a heddle sensor 108 attached to the upper end of the post 107 in a horizontal position to detect the heddle 5, and a heddle frame sensor 109 attached to the upper end of the post 107 in a vertical position to identify one of the plurality of heddle frames 4. The heddle frame identifying device 100 is supported for lateral movement along the width of the fabric 8 on an endless belt 102 extended between a pair of pulleys 101 and driven by a motor, not shown. As shown in FIG. 13, the plurality of heddle frames 4, four heddle frames 4 in this embodiment, are arranged one after another along the warps 1. All the warps 1 are drawn respectively through the heddles 5 on the four heddle frames 4 according to a sequentially repetitive drawing plan, in which every fourth warp 1 is drawn through the heddle 5 on the same heddle frame 4. The two successive warps 1 are drawn through the same slit between the dents 61. Thus, the two warps 1 drawn through the same slit between the dents 61 are in a fixed relation with respect to the numbers of the heddle frames 4. Identification codes 45 respectively corresponding to the numbers of the heddle frames 4 are assigned to the heddles 5. The identification code 45 of each heddle 5 is stored in a storage device 46 for each of the two warps 1 drawn through the slit between the dents 61 corresponding to the same heddle 5.

In detecting the number of the heddle frame 4 supporting the heddle 5 corresponding to the broken warp 1', the heddle frame identifying device 100 is advanced toward the trailing portion 1*a* of the broken warp 1' by a predetermined distance. Then, the motor 104 is driven for rotation in the normal direction to advance the sensors 108 and 109 toward the heddle 5. Upon the detection of the first heddle frame 4 by the heddle frame sensor 109, a controller, not shown, starts a counting operation to count the revolutions of the motor 104. Upon the detection of the heddle 5 by the heddle sensor 108, the counting operation is stopped and the number of the heddle frame 4 is determined by calculation on the basis of the counted revolutions of the motor 104.

For example, the number of revolutions of the motor 104 necessary for moving the heddle frame identifying device 100 from one of the heddle frames 4 to the next is stored beforehand in the controller, and the number of the counted revolutions is divided by the previously stored number of revolutions to identify the heddle frame 4. Thus, the identification code 45 of the heddle 5 corresponding to the broken warp 1' is detected. After detection, the motor 104 is driven for reverse rotation to retract the sensors 108 and 109 and, if necessary, the motor 104 is actuated to shift the heddle identifying device 100 laterally.

Figure 14:
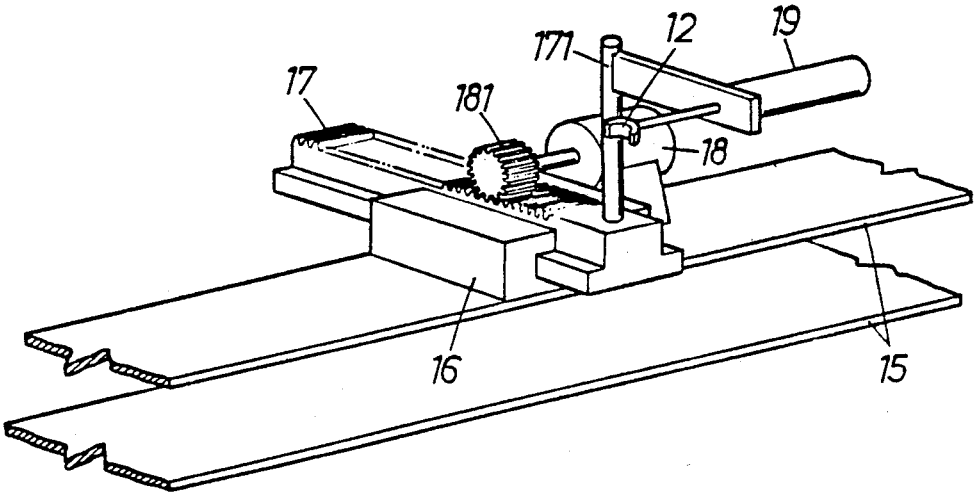
FIGS. 14 to 16 are perspective views of mechanisms employed for carrying out the method in the first embodiment according to the present invention.

As shown in FIG. 14, a separating member moving device for moving the yarn separating member 12 comprises an endless belt 15, a guide member 16 attached to the endless belt 15, a sliding rack 17 supported for sliding movement along the warps 1 on the guide member 16, a pinion 181 engaging the sliding rack 17, a motor for driving the pinion 181, a post 171 attached in a vertical position to the sliding rack 17, and a pneumatic actuator 19 held on the post 171 to move the yarn separating member 12 laterally to restrain the heddle 5 from movement.

Figure 15:
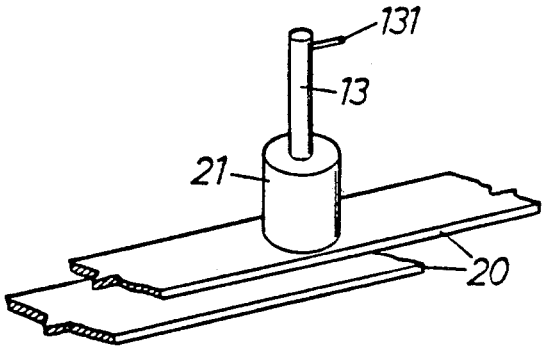

As shown in FIG. 15, the raising member 13 is raised by a predetermined distance by a solenoid 21 supported in a vertical position on a belt 20. The raising member 13 is moved laterally together with the solenoid 21 by the belt 20.

Figure 16:
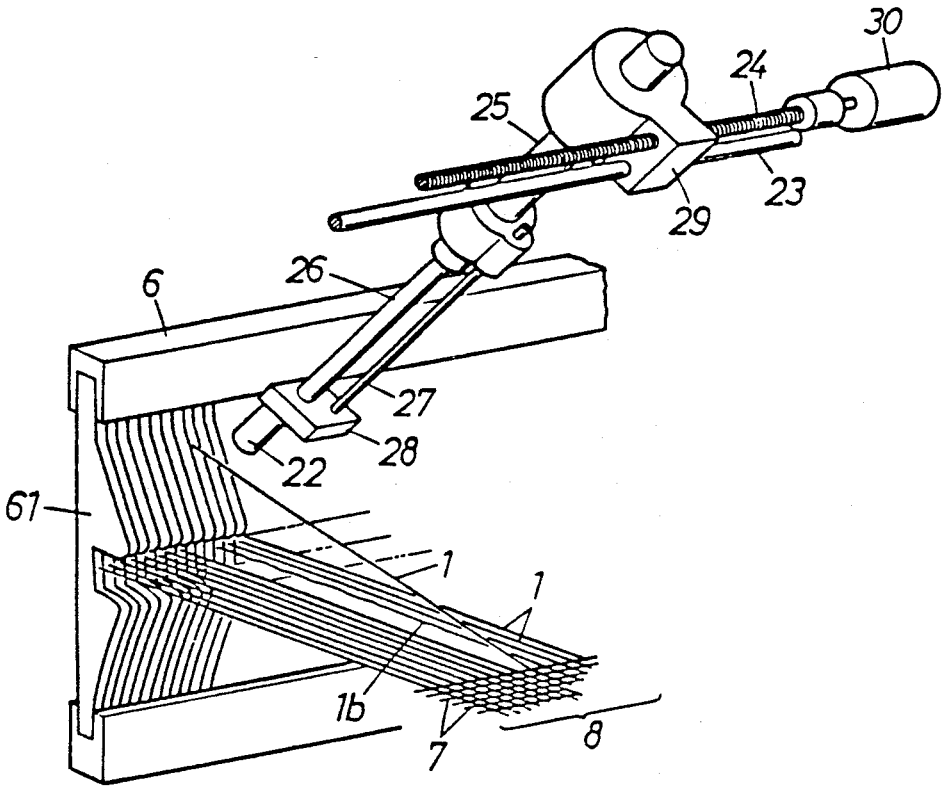

As shown in FIG. 16, the yarn sensor 22 is attached to a holder 28 attached to the extremity of the piston rod 26 of a pneumatic actuator 25. The holder 28 is restrained from rotation by a guide bar 27. The pneumatic actuator 25 is held on a slider 29 engaging a screw rod 24 and guide by a guide bar 23. The screw rod 24 is rotated by a motor 30 to move the slider 29 laterally together with the pneumatic actuator 25. Thus, the position of the slit between the dents 61 corresponding to the broken warp 1' can be determined on the basis of the positional relation between the slit between the dents 61 corresponding to the raised warp 1, which is determined from the number of revolutions of the motor 30 from a reference point at the moment of detection of the raised warp 1 by the yarn sensor 22, and the slit between the dents 61 corresponding to the broken warp 1'.

Figure 17:
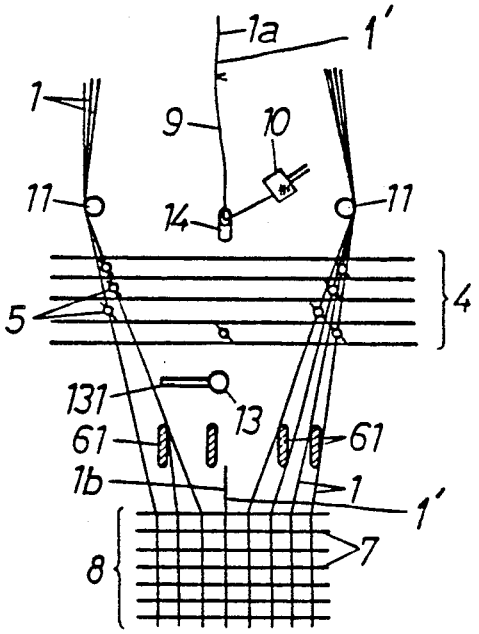
FIGS. 17 and 18 are diagrammatic plan views for assisting in explaining the steps of a modified method.
Figure 18:
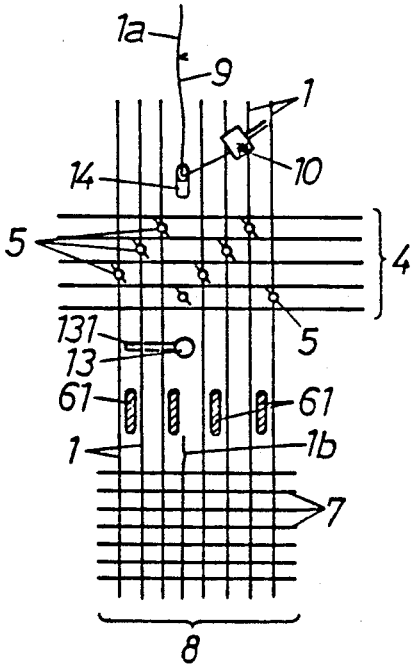

In a modification shown in FIGS. 17 and 18, there is described the next normal warp which is vertically displaced without using the yarn separating member 12.

Referring to FIG. 17, according to a procedure to be carried out by this modification, similarly to the procedure carried out by the method in the foregoing embodiment, the normal warps 1 are separated from the broken warp 1' by a pair of yarn separating members 11, a mending yarn 9 is tied to the trailing portion 1*a* of the broken warp 1', and the free end of the mending yarn 9 is held by a mending yarn holder 10 and a suction holder 14. Then, a raising member 13 is moved near to the normal warp 1' adjacent to the broken warp 1'. A distance to be traveled by the raising member 13 is determined with reference to the position of a dropped drop wire 3 corresponding to the broken warp 1' or a position signal indicating the position of a heddle frame 4 supporting a heddle 5 corresponding to the broken warp 1'.

Subsequently, the yarn separating members 11 are lowered to allow the normal warps 1 to move into the normal parallel arrangement as shown in FIG. 18. In this state, the two successive normal warps 1 on the left-hand side of the broken warp 1' extend over the hook 131 of a raising member 13. Then, the raising member 13 is raised to raise the two normal warps 1 with the hook 131 so that they are separated from the rest of the normal warps 1 and can be detected by a yarn sensor 22. The position of the right-hand raised normal warp 1 with respect to the direction along the weaving width is detected. Thereafter, the same steps as those in the foregoing embodiment are executed to draw the mending yarn 9 through the mails of the corresponding heddle 5 and the corresponding slit in the reed 6.

In either the first embodiment or the modification of the first embodiment, a normal warp or warps 1 in a predetermined relation with the broken warp 1' are raised; the warp 1 to be raised may be the warp 1 next to the broken warp 1' to either the right or the left thereof or may be the warp 1 a predetermined number of warps 1 to either the right or the left of the broke warp; or the normal warp which is inserted through the same dents as the broken warp 1' is selected and displaced vertically. In any case, the conditions specifying the positional relation between a slit between the dents 61 corresponding to the broken warp 1' and a slit between the dents 61 corresponding to the vertically displaced normal warp 1 can be determined provided that the vertically displaced normal warp 1 is in a predetermined relation with the broken warp 1', when the number of the heddle frame 4 supporting the heddle 5 corresponding to the broken warp 1' is known. The conditions may be determined on the basis of the number of the heddle frame 4 corresponding to the broken warp 1' and the drawing plan or may be determined by assigning identification codes respectively to all the drop wires 3 of the warp stop motion detector 2 as stated in Japanese Patent Laid-open Publication No. 1-174649 and finding the number of the heddle frame 4 corresponding to the broken warp 1' on the basis of the identification code assigned to the drop wire 3 corresponding to the broken warp 1'.

The method in the foregoing embodiment is not the only method for detecting the number of the heddle frame 4; rather the number of the heddle frame 4 supporting the heddle 5 corresponding to the broken warp 1' may be detected by a known warp stop motion detector which detects the breakage of a warp 1 through the detection of the drop of the heddle 5.

The method in the first embodiment provides the following advantages.

Since the position, with respect to the width of the reed, of a slit between the dents corresponding to a broken warp is determined indirectly through the detection of the position, with respect to the width of the reed, of a normal warp vertically displaced relative to other warps and in a predetermined positional relation with the broken warp, the normal warp is not subjected to an excessive tension and is not broken during the detection of the position of the slit corresponding to the broken warp.

Furthermore, the slit between the dents corresponding to the broken warp can be reliably detected even if the dents have a comparatively high rigidity such that it is difficult to bend then laterally.

Second Embodiment (FIGS. 19 to 31)

FIGS. 19 to 31 are diagrammatic illustrations showing warps on a loom in sequential stages of a method of locating a slit between the dents by vertically moving a broken warp in a second embodiment according to the present invention.

Figure 19:
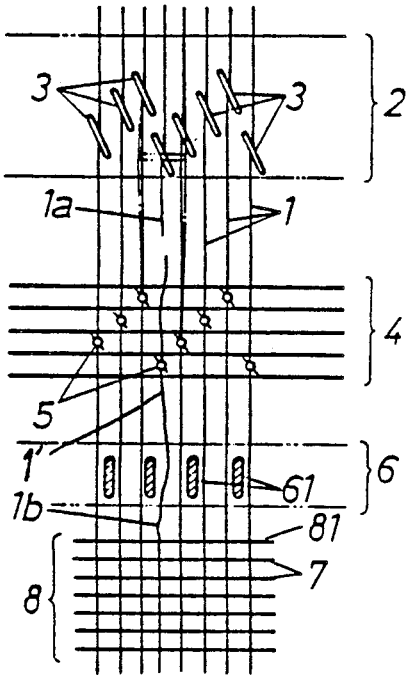
FIG. 19 to 26 are diagrammatic views for assisting in explaining the steps of a method of locating dents corresponding to a broken warp i a second embodiment according to the present invention, FIGS. 19, 20 , 22, 24 and 25 being plan views, and FIGS. 21, 23 and 26 being side views.

Referring to FIG. 19, when one of a plurality of warps 1 is broken at a position between the warp beam, not shown, and the reed 6 while the loom is in weaving operation, a drop wire 3 corresponding to the broken warp 1' drops. Upon the detection of the drop of the drop wire 3, a warp stop motion detector 2 provides a stop signal to stop the loom automatically at a predetermined angular position. Subsequently, all the heddle frames 4 are leveled substantially with each other by a leveling device, not shown, to arrange all the warps 1 in a state appropriate to mending the broken warp 1', for example, in a state for a closed shed. The warps 1 are extended in parallel to each other in a sheet and are drawn through heddles 5 supported on a plurality of heddle frames, for example, four heddle frames 4, in a predetermined repetitive sequence according to a drawing plan. The warps 1 are drawn through slits between the dents 61 of a reed 6, for example, in a reed draft of two warps through each slit. The warps 1 are interlaced with a weft at the cloth fell 81 to weave a fabric 8.

The normal warps 1 adjacent to the broken warp 1' are separated from the broken warp 1' by laterally reciprocating the drop wire 3 corresponding to the broken warp 1' by a device disclosed, for example, in Japanese Patent Laid-open Publication No. 62-69851 or by turning the drop wire 3 corresponding to the broken warp 1' in a direction perpendicular to the broken warp 1' by a device disclosed in Japanese Patent Laid-open Publication No. 63-28951.

Figure 20:
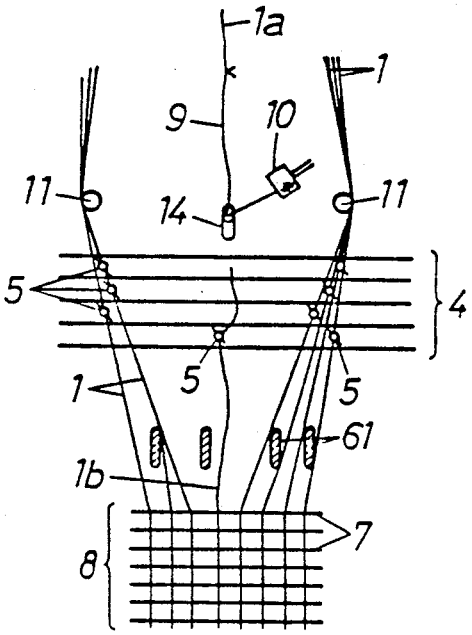

Then, as shown in FIG. 20, a pair of yarn separating members 11 are inserted in small spaces formed respectively on the opposite sides of the broken warp 1' by separating the normal warps 1' from the broken warp 1', for example, from below the sheet of the warps 1 in a region near the arrangement of the drop wires 3 of the warp stop motion detector 2, and then the yarn separating members 11 are moved laterally in respectively opposite directions to form comparatively large spaces respectively on the opposite sides of the broken warp 1' in order that the extraction of the trailing portion 1*a* of the broken warp is facilitated. Then, a mending yarn 9 is connected to the trailing portion 1*a* of the broken warp 1' by a knotter of a mechanical knotting type or a bonding type. The free end of the mending yarn 9 is held by a mending yarn holder 10, and a suction holder 14 or a gripper in the vicinity of the slit between the dents 61 corresponding to the broken warp 1'.

Figure 28:
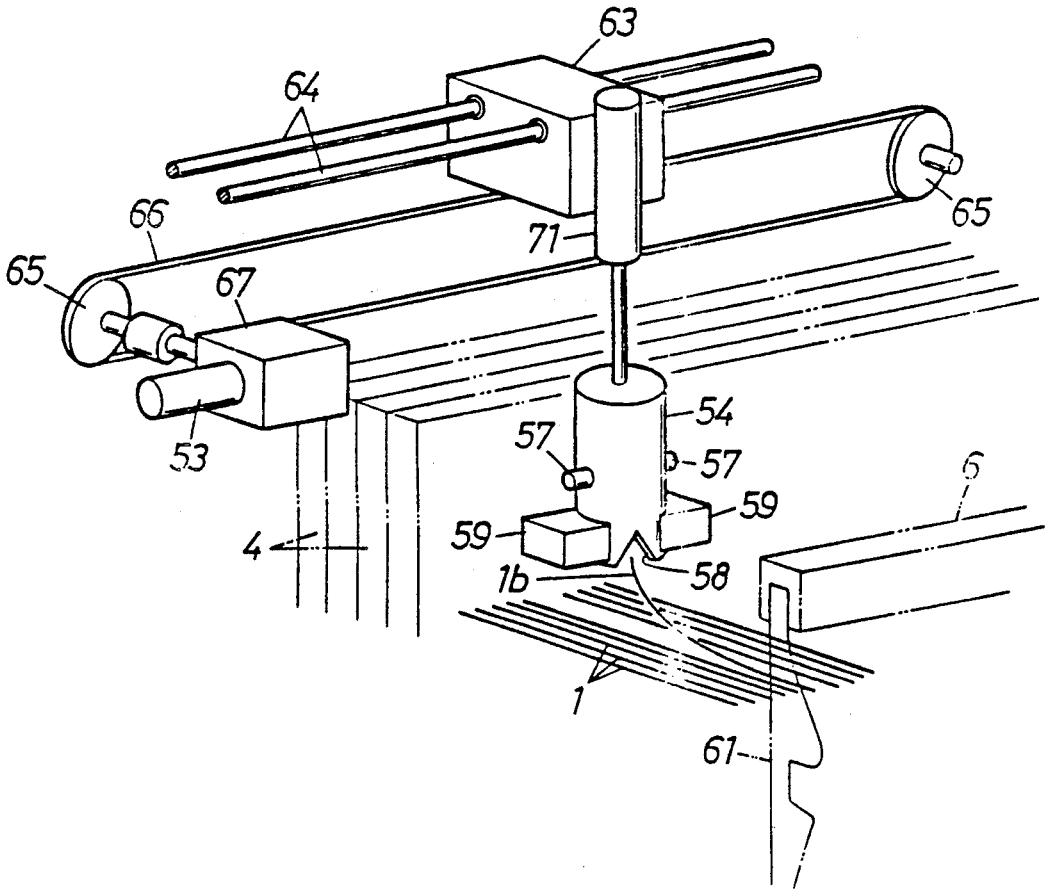
FIG. 28 is a perspective view of a suction pipe and its associated parts.
Figure 29:
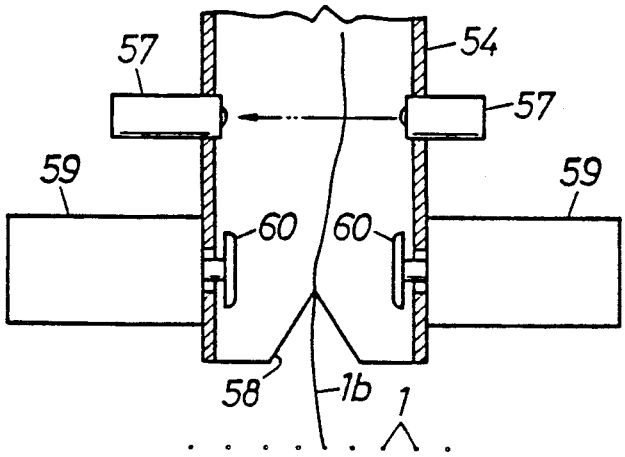
FIG. 29 is a longitudinal sectional view of the suction tube of FIG. 28.

After thus completing the preparatory steps, a controller 51 (FIG. 27) starts a control operation according to a program upon the reception of an operation command from a main controller, not shown. The controller 51 controls a motor drive 52 on the basis of information indicating the position of the dropped drop wire 3 with respect to the direction of the weaving width so as to drive a motor 53 so that a suction pipe 54 is moved from its standby position to a position corresponding to that of the broken warp 1' in a space between the heddle frame 4 and the reed 6. The position of the dropped drop wire 3 is determined by measuring the distance between one of the selvages of the fabric 8 and the dropped drop wire 3 by a sonic distance measuring device or by reading a distance data previously stored in a storage corresponding to a code assigned to the dropped drop wire 3. As shown in FIG. 28, the suction pipe 54 is attached to the extremity of the piston rod of a pneumatic actuator 71 attached to a slider 63 and is restrained from turning. The slider 63 is supported for sliding movement on two guide rods 64 extended across the loom. The slider 63 is connected to an endless belt 66 extended between a pair of pulleys 65. One of the pair of pulleys 65 is mounted on the output shaft of a reduction gear 67 having an input shaft coupled with the output shaft of the motor 53. The motor 53 drives the endless belt 66 through the reduction gear 67 and the pulley 65 to move the suction pipe 54 along the guide rods 64. Upon the arrival of the suction pipe 54 at a desired position, the controller 51 opens a solenoid valve 55 to connect the suction pipe 54 to a vacuum means 56 to suck the free end of the leading portion 1*b* of the broken warp 1' into the suction pipe 54. The suction of the free end of the leading portion 1*b* of the broken warp 1' is detected by, for example, an optical sensor 57 provided within the suction pipe 54. Upon the detection of the free end of the leading portion 1*b* of the broken warp 1', the optical sensor 57 gives a yarn detection signal to the controller 51. As shown in FIG. 29, a portion of the leading portion 1*b* of the broken warp 1' sucked into the suction pipe 54 is positioned by a positioning slit 58 having the shape of an inverted letter V and formed diametrically in the lower end of the suction pipe 54 so as to extend in the central portion of the interior of the suction pipe 54. Then, the controller 51 controls a solenoid driver 74 to actuate a pair of solenoids 59 provided at the lower ends of the suction pipe 54 to grip the leading portion 1*b* of the broken warp 1' with a pair of gripping members 60 by friction, and controls a selector valve 62 so as to supply compressed air from a compressed air source 75 to the pneumatic actuator 71 so that the suction pipe 54 is raised.

Figure 21:
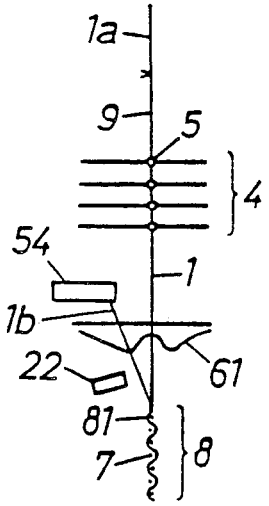

Thus, the leading portion 1*b* of the broken warp 1' extending through the slit between the dents 61 corresponding to the broken warp 1' is raised to a level above that of the normal warps 1 and is extended tautly between the cloth fell 81 and the positioning slit 58 as shown in FIG. 21.

Figure 27:
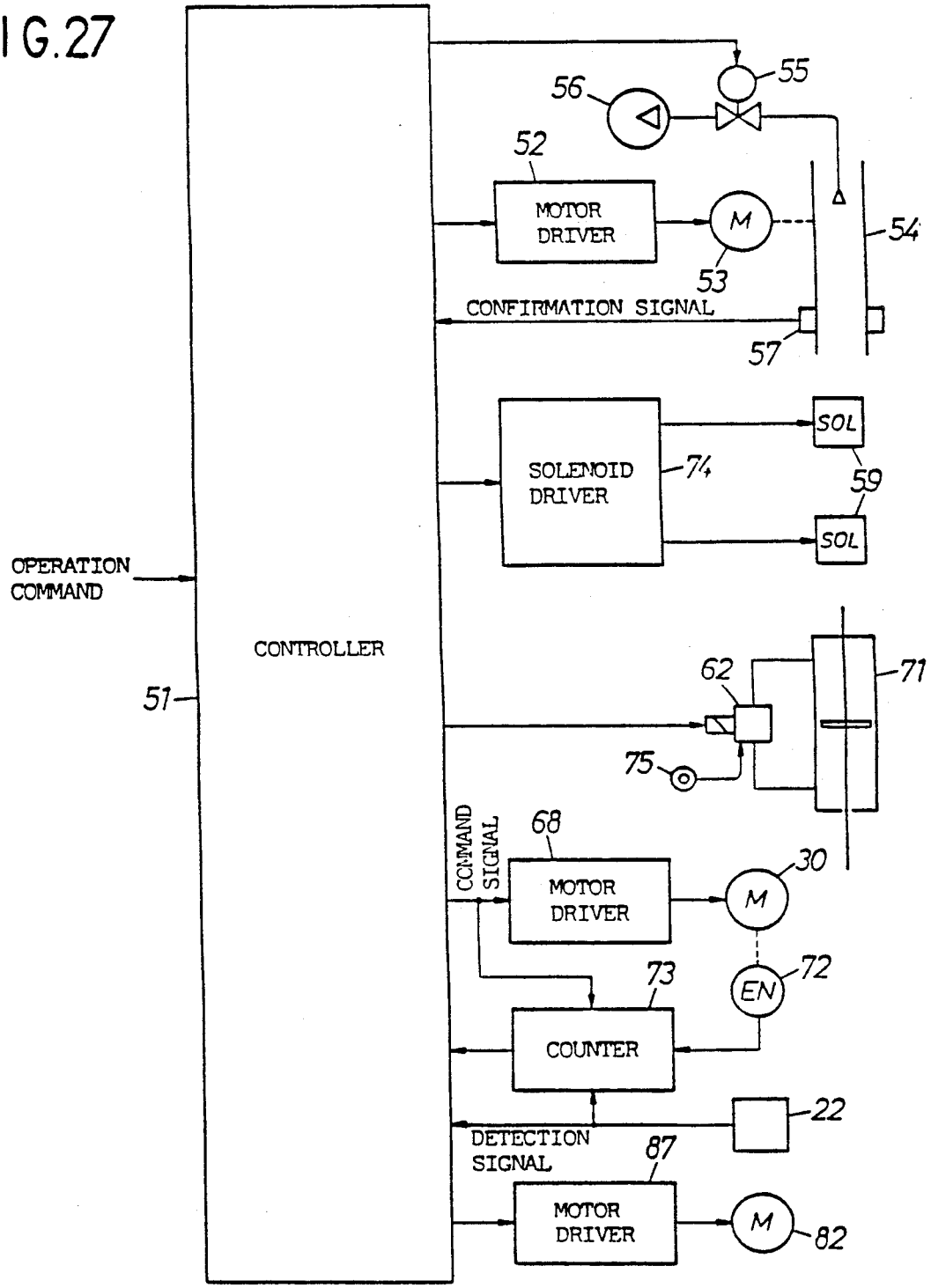
FIG. 27 is a block diagram of a control system.

Then, the controller 51 shown in FIG. 27 gives a drive command to a motor driver 68 to actuate a motor 30 to move a yarn sensor 22 from a position corresponding to one of the selvages toward the other selvage along the front side of the reed 6 for the detection of the raised trailing portion 1*b* of the broken warp 1', and to a counter 73 to start a counting operation. While the motor 30 is driving the yarn sensor 22, the counter 73 counts pulses generated by a shaft encoder 72 associated with the motor 30.

Upon the arrival of the yarn sensor 22 at a position opposite the leading portion 1*b* of the broken warp 1', the yarn sensor 22 detects the leading portion 1*b* of the broken warp 1' and gives a detection signal to the controller 51, and then the controller 51 stops the motor 30 and the counter 73. The count of the pulses counted by the counter 73 during the movement of the yarn sensor 22 from its standby position to the position opposite the leading portion 1*b* of the broken warp 1' indicates the position of the slit between the dents 61 on the reed 6 corresponding to the broken warp 1.

The count of the pulses is used as data for positioning the threading device 31 relative to the reed 6.

Figure 22:
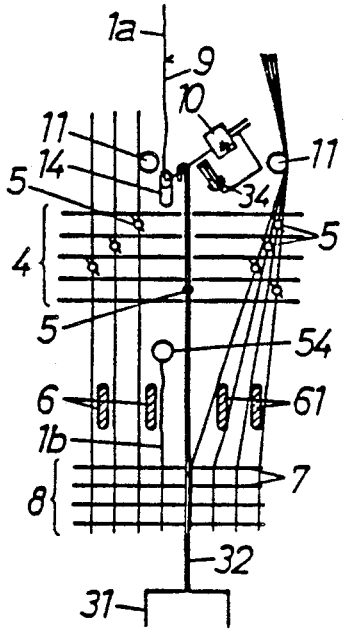
Figure 23:
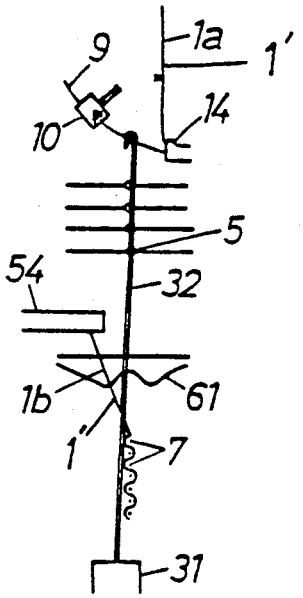
Figure 24:
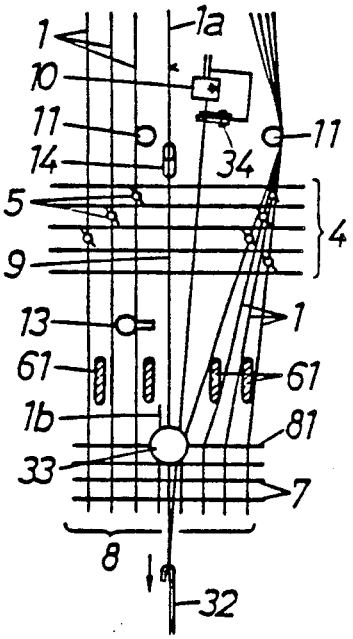
Figure 25:
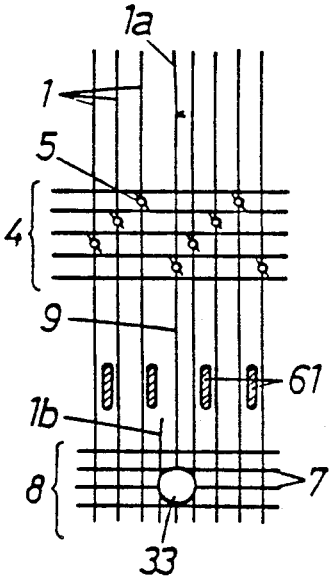
Figure 26:
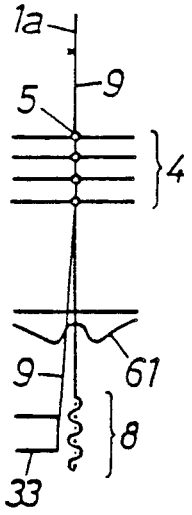
Figure 30:
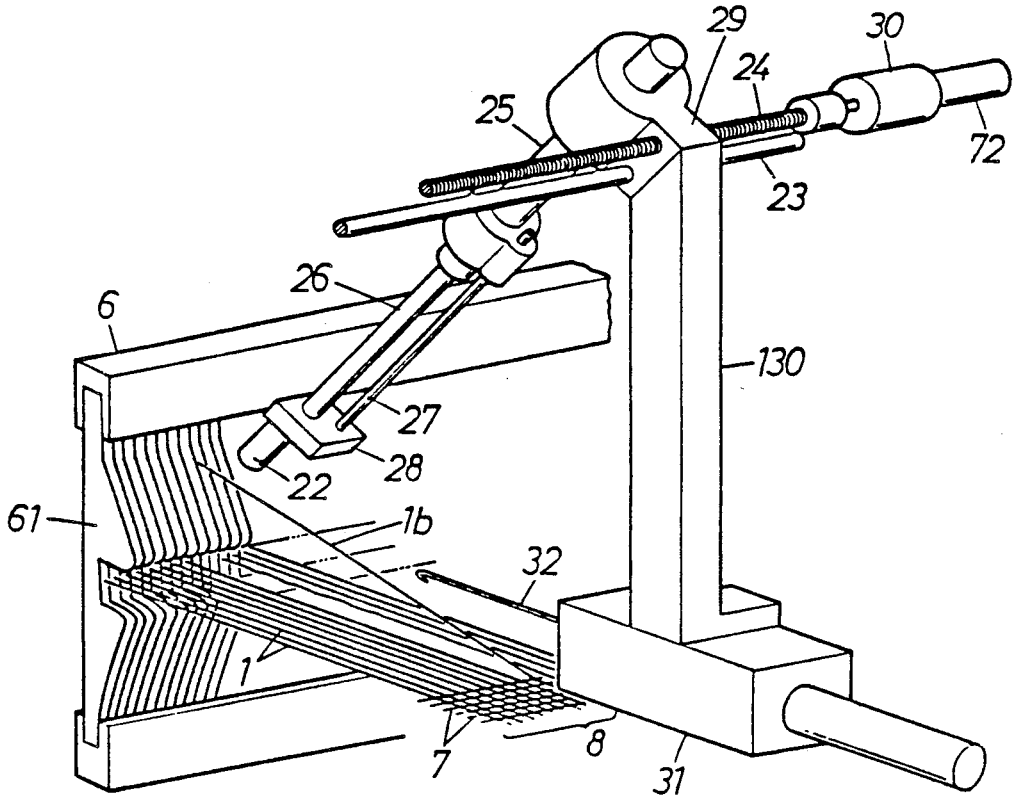
FIG. 30 is a perspective view of a yarn sensor, a threading device and associated parts.

As shown in FIG. 30, the threading device 31 is attached to a bracket 130 attached to an internally threaded slider 29 engaging a screw rod 24 and supported for sliding movement on a guide rod 23. The hooked needle 32 of the threading device 21 is aligned with the yarn sensor 22 with respect to a direction parallel to the warps 1. As shown in FIGS. 22 to 24, the hooked needle 32 is passed through the slit between the dents 61 corresponding to the broken warp 1' and through the mail of a heddle 5 corresponding to the broken warp 1', and then the hooked needle 32 is retracted after hooking the mending yarn 9 to draw the mending yarn through the heddle 5 and to draw the same through the reed 6. The heddle 5 corresponding to the broken warp 1' is positioned in alignment with the slit between the dents 61 corresponding to the broken warp 1' by a heddle positioning device, not shown, which is controlled by the controller 51 according to the data indicating the position of the slit between the dents 61 corresponding to the broken warp 1'. During the retraction of the hooked needle 32 to draw the mending yarn through the reed 6, a cutter 34 cuts the mending yarn 9 at a position near the mending yarn holder 10. The free end of the mending yarn 9 is held near the cloth fell 81 by an operator or by the suction pipe 33 before restarting the loom. The yarn separating members 11 and the suction pipe 54 are returned to their standby position before restarting the loom After the loom has been started, the mending yarn 9 is woven into the fabric 8 and the floating portion of the mending yarn is cut off.

If the hooked needle 32 of the threading device 31 is held at a normal distance from the yarn sensor 22 on one side of the latter, the controller 51 drives the motor 30 after the detection of the leading portion **1*b* of the broken warp 1' to position the hooked needle 32 opposite to the slit between the dents 61 corresponding to the broken warp 1'**.

Figure 31:
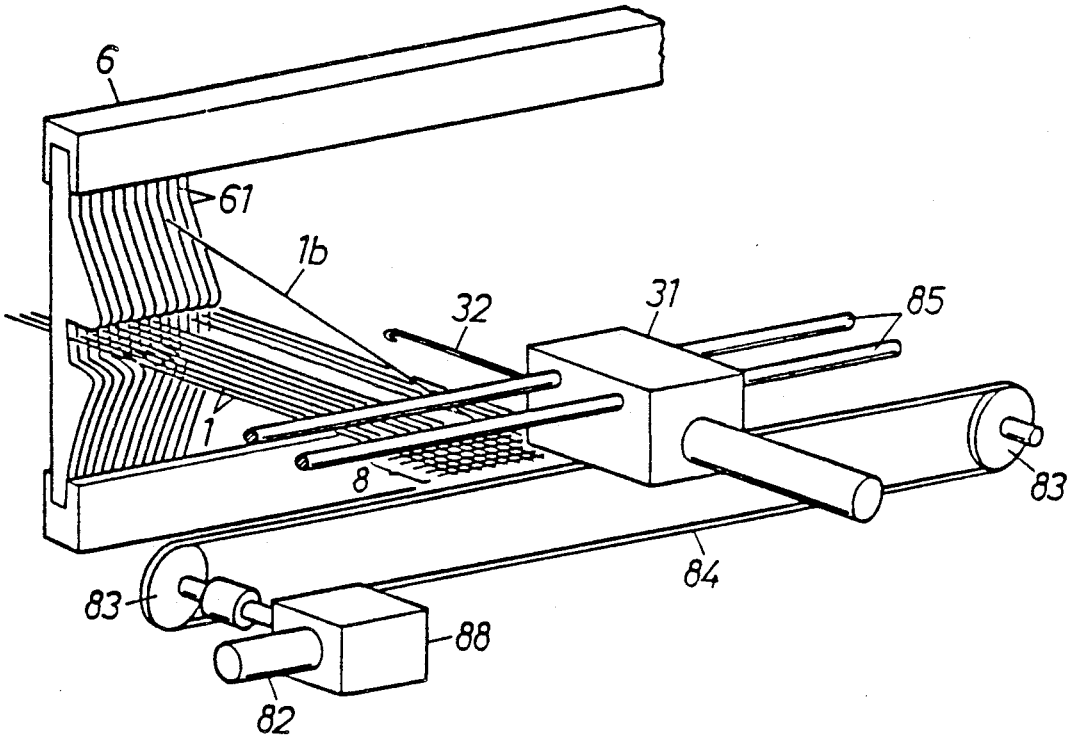
FIG. 31 is a perspective view of another threading device and its associated parts.

When the threading device 31 is moved by a moving mechanism separate from that for moving the yarn sensor 22 as shown in FIG. 31, the controller controls a motor driver 87 so as to drive a motor 82 to move the threading device 31 from its standby position by a distance corresponding to the distance between the standby position of the yarn sensor 22 to the position opposite the slit between the dents 61 corresponding to the broken warp 1'. The threading device 31 is attached to an endless belt 84 extended between a pair of pulleys 83 disposed respectively near the selvages. The motor 82 drives one of the pair of pulleys 83 through a reduction gear 88 to move the threading device 31 along two guide rods 85 extended along the reed 6 to position the hooked needle 32 opposite to the slit between the dents 61 corresponding to the broken warp 1'. Then, the hooked needle 32 is operated in the foregoing manner to draft the mending yarn through the heddle 5 and to draw the same through the reed 6.

In this embodiment, the pair of gripping members 60 are provided within the suction pipe 54. The gripping members 60 may be provided outside the suction pipe 54 and may be moved vertically by a pneumatic actuator after gripping the free end of the leading portion **1*b* of the broken warp 1' to move vertically the leading portion 1*b* of the broken warp 1' sucked in the suction pipe 54. It is also possible to omit the gripping members 60 and to move the leading portion 1*b* of the broken warp 1' only by the action of the suction pipe 54**.

The suction pipe 54 is able to suck the leading portion **1*b* of the broken warp 1' during travel toward the leading portion 1*b* of the broken warp 1' before arriving at the position accurately opposite the slit between the dents 61 corresponding to the broken warp 1'. Therefore, the position of the dropped drop wire 3 can be used as data for moving the suction pipe 54 along the reed 6. If the suction pipe 54 is omitted and the leading portion 1*b* of the broken warp is caught only by the pair of gripping members 60, the pair of gripping members 60 must be positioned accurately at a position where the pair of gripping members 60 are able to grip the leading portion 1*b* of the broken warp 1'. Accordingly, position data more accurate than the data indicating the position of the dropped drop wire 3 is necessary. It is preferable to use, for example, position data obtained by detecting the spaces formed by separating the normal warps 1 from the broken warp 1'** by a sensor.

In this embodiment, the leading portion of the broken warp is displaced vertically along the dents and the slit between the dents corresponding to the broken warp is located through the detection of the leading portion of the broken warp. Therefore, the separation of the normal warps adjacent to the broken warp from the broken warp, and the identification of the relation between the normal warps and the broken warp are unnecessary and, consequently, the position of the slit between the dents corresponding to the broken warp can readily be determined through simple control operation and the simple operation of the mechanisms.

Third Embodiment

Figure 32:
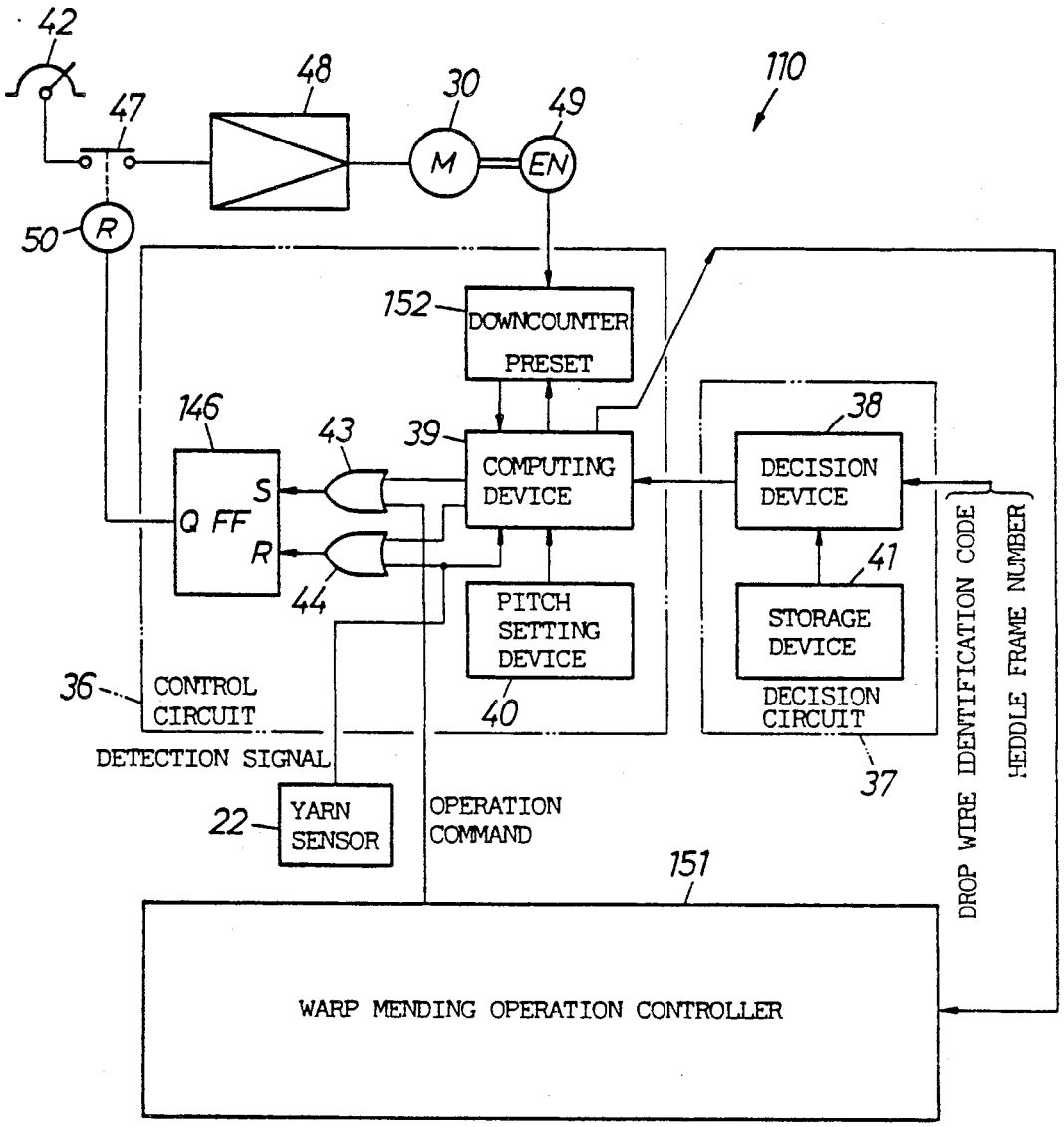
FIG. 32 is a block diagram of a controller employed in carrying out a method of locating dents corresponding to a broken warp in a third embodiment according to the present invention.

Referring to FIG. 32, a position controller 110 for the threading device 31 controls the motor 30 (FIG. 16 or 30) on the basis of the detection signal provided by the yarn sensor 22.

After the normal warp 1' or the broken warp 1 is vertically displaced, a warp mending operation controller 151 provides a command to set a flip flop 146 through the internal OR gate 43 of a control circuit 36, and then a relay 50 closes a contact 47. Then, a driving amplifier 48 drives the motor 30 to rotate the motor 30 at a rotating speed set by a speed setting device 42, whereby the yarn sensor 22 and the threading device 31 are moved along the reed 6 from their standby positions near the selvage. Upon the detection of the displaced normal war 1 during the movement along the reed 6, the yarn sensor 22 provides a detection signal, which resets the flip flop 146 through an OR gate 44 to stop the motor 30. Thus, the yarn sensor 22 is positioned accurately at a position opposite to the displaced normal warp 1 or the broken warp 1'.

Figure 33:
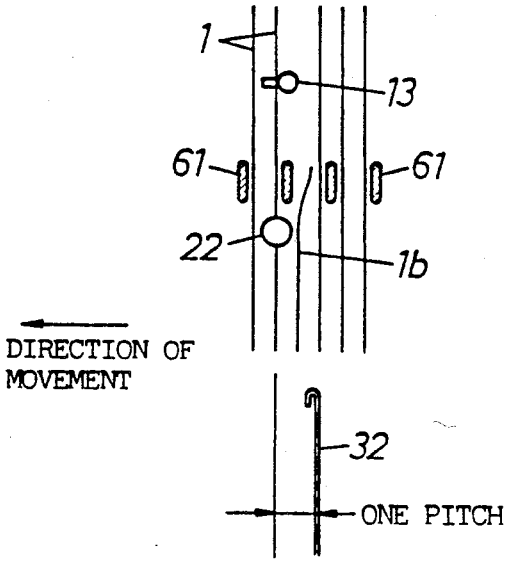
FIGS. 33 and 34 are diagrammatic plan views showing the positional relation between a yarn sensor and a threading device.

The detection signal of the yarn sensor 22 is given also to a computing device 39. The computing device 39 computes the normal distance between the slit between the dents 61 corresponding to the broken warp 1' and the position corresponding to the hooked needle 32 on the basis of the positional relation between the slit between the dents 61 corresponding to the broken warp 1' and the slit between the dents 61 corresponding to the displaced normal warp 1 or the broken warp 1', and the normal distance between the yarn sensor 22 and the hooked needle 32. For example, when the yarn sensor 22 is ahead of the hooked needle 32 of the threading device 31 by a distance corresponding to the pitch of the dents 61 with respect to the direction of movement of the threading device 31 as shown in FIG. 33, the hooked needle 32 is accurately opposite to the slit between the dents 61 corresponding to the broken warp 1' when the displaced normal warp 1 is detected by the yarn sensor 22. The computing device 39 receives data representing the positional relation namely, data indicating that the slit between the dents 61 corresponding to the broken warp 1' is to the right from the slit between the dents 61 corresponding to the displaced normal warp or the broken warp 1 1 by a distance corresponding to the pitch of the dents 61, and determines that the hooked needle 32 is positioned opposite to the slit between the dents 61 corresponding to the broken warp 1' from the data indicating the positional relation, and the data indicating the normal distance between the yarn sensor 22 and the threading device 31. Then, the computing device 39 gives a command to the warp mending operation controller 151 to operate the threading device 31.

Figure 34:
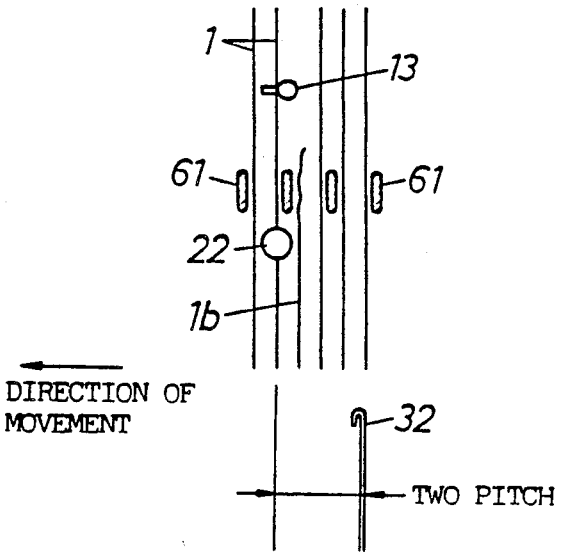

However, if the yarn sensor 22 and the hooked needle 32 are disposed with a normal distance corresponding to the pitch of the dents 61 therebetween as shown in FIG. 34, the computing device 39 decides, on the basis of the normal distance between the yarn sensor 22 and the hooked needle 32, i.e., the pitch of the dents 61, and data indicating the positional relation given thereto by a decision circuit 37, that the hooked needle 32 is positioned at a normal distance corresponding to the pitch of the dents 61 to the right from the slit between the dents 61 corresponding to the broken warp 1', receives data corresponding to the pitch of the dents 61, sets the flip flop 146, and drives the motor 30 to advance the hooked needle 32 further by a distance corresponding to the pitch of the dents 61.

A decision device 38 included in the decision circuit 37 decides the positional relation between the slit between the dents 61 corresponding to the broken warp 1' and the slit between the dents 61 corresponding to the displaced normal warp 1 or the broken warp 1' in a predetermined relation with the broken warp 1' on the basis of data indicating the number of the heddle frame supporting a heddle corresponding to the broken warp 1', and the contents of a storage device 41, and gives data representing the positional relation to the computing device 39 of the control circuit 36. The storage device 41 stores the specific relation between the broken warp 1' and the normal warp 1 to be displaced relative to the broken warp 1', namely, a rule that the next warp 1 on the left of the broken warp 1' is displaced.

The computing device 39 sets the flip flop 146 to drive the motor 30 for rotation in the normal direction, i.e., the direction for advancing the yarn sensor 22 and the threading device 31, and sets a down counter 152 for the pitch of the dents 61 set by a pitch setting device 40. The downcounter decrements the set count by one for every reception of a pulse from an encoder 49. Upon the reduction of the count on the down counter 152 to "0" the computing device 39 resets the flip flop 146 to stop the motor 30 and provides a command signal to actuate the warp yarn mending operation controller 151. Then, the warp yarn mending operation controller 151 controls the threading device 31 according to a threading procedure.

If the warps 1 are drawn through the reed 6 one warp through each slit between the dents 61, the decision device 38 of the decision circuit 37 makes a decision only on the basis of the predetermined positional relation between the broken warp 1' and the displaced warp 1 without making a decision on the positional relation between the slit between the dents 61 corresponding to the broken warp and that between the dents 61 corresponding to the displaced warp 1.

Figure 35:
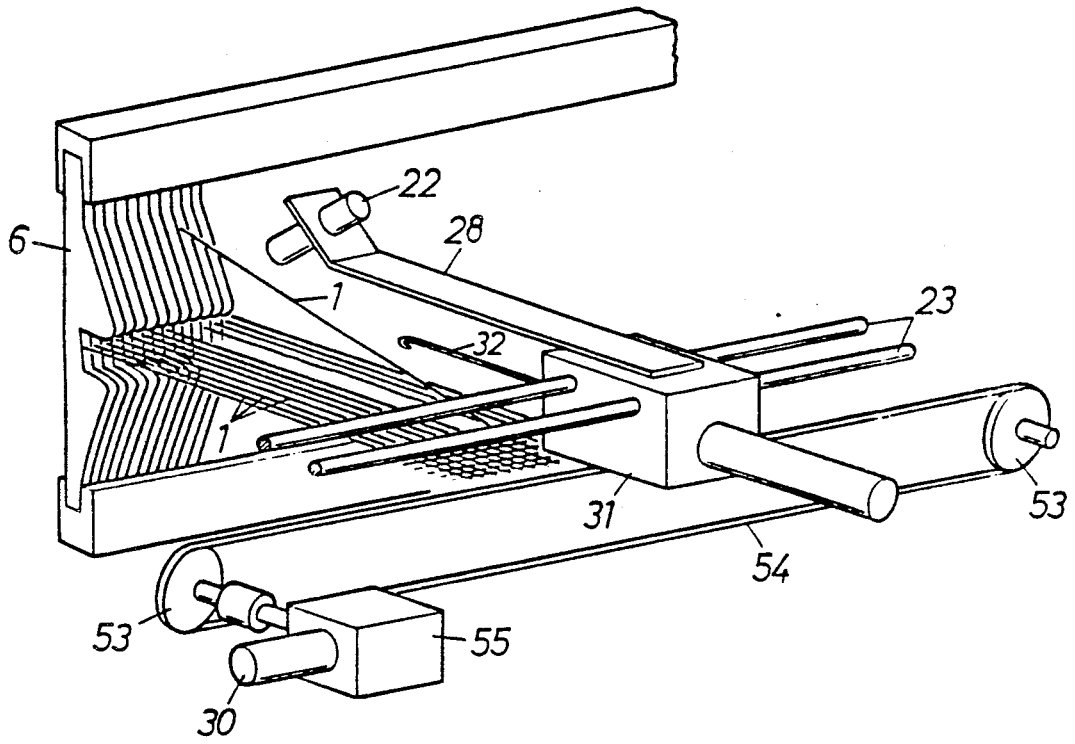
FIG. 35 is a perspective view of another moving means.

The yarn sensor 22 may be held on the threading device 31 as shown in FIG. 35 and may be positioned by the mechanism shown in FIG. 31. The position controller 110 also controls the motor 82.

In this embodiment, the yarn sensor 22 and the threading device 31 are moved together by a single moving mechanism of a simple construction. Therefore, the threading device need not be moved or needs to be moved by a very small distance after the detection of the warp in the predetermined relation with the broken warp, so that the threading device can accurately be positioned relative to the slit between the dents corresponding to the broken warp to ensure correct threading operation.

What is claimed is:

1. A method of locating a slit between dents of a reed of a loom corresponding to a broken warp, comprising the steps of:

extracting a normal warp in a predetermined positional relation with a broken warp by catching the normal warp at a position between a heddle through which the normal warp is drawn and the reed of the loom;

vertically displacing the extracted normal warp relative to other warps;

detecting the displaced normal warp to determine the position of the displaced normal warp on the reed with respect to the direction of the weaving width; and locating a slit between the dents of the reed corresponding to the broken warp on the basis of the position of the displaced normal warp on the reed.

2. A method of locating a slit between dents of a reed of a loom corresponding to a broken warp, comprising the steps of:

extracting a leading portion of a broken warp by catching the leading portion at a position between a heddle through which the broken warp is to be drawn after mending and the reed of the loom;

vertically displacing the leading portion relative to normal warps; and locating a slit between the dents of the reed corresponding to the broken warp through the detection of the vertically displaced leading portion of the broken warp.

3. A slit locating and threading apparatus comprising:

a threading device for drawing a mending yarn connected to a trailing portion of a broken warp through a slit between dents of a reed of a loom corresponding to a broken warp, said threading device being movable in the direction of the weaving width;

a yarn sensor provided on the threading device for movement together with the threading device;

an extracting member for extracting a normal warp in a predetermined relation with the broken warp by catching the normal warp at a position between a heddle and the reed and vertically displacing the normal warp relative to other warps;

a decision circuit which decides the positional relation between a slit between the dents corresponding to the broken warp and a slit between the dents corresponding to the vertically displaced normal warp; and a control circuit for causing the yarn sensor to move in the direction of the weaving width to detect the displaced normal warp, for locating the slit between the dents corresponding to the broken warp on the basis of the position of the yarn sensor at the detection of the displaced normal warp and the result of decision of the decision circuit, and for positioning and operating the threading device at a position corresponding to the slit between the dents corresponding to the broken warp.

* * * * *